US006091379A

United States Patent [19]

Song

[11] Patent Number: 6,091,379

[45] Date of Patent: Jul. 18, 2000

[54] ELECTRON GUN FOR COLOR CATHODE RAY TUBE

[75] Inventor: Byungkwon Song, Seoul, Rep. of Korea

[73] Assignee: LG Electronics, Inc., Seoul, Rep. of Korea

[21] Appl. No.: 09/023,285

[22] Filed: Feb. 13, 1998

[30] Foreign Application Priority Data

Feb. 19, 1997 [KR] Rep. of Korea ..... 97-4947

[51] Int. Cl.[7] ..... G09G 1/06

[52] U.S. Cl. ..... 345/11; 313/414; 315/382.1

[58] Field of Search ..... 345/10–15; 313/414, 313/412, 413, 441, 446–449; 315/382, 382.1; 348/377–382, 552, 554, 555, 805, 806

[56] References Cited

U.S. PATENT DOCUMENTS 5,350,978 9/1994 Chen ..... 313/447
5,483,128 1/1996 Chen ..... 315/382
5,689,158 11/1997 Chen ..... 313/414

*Primary Examiner*—Regina Liang
*Attorney, Agent, or Firm*—Fleshner & Kim, LLP

[57] ABSTRACT

Electron gun for a color cathode ray tube, is disclosed, the color cathode ray tube having a plurality of cathodes for emitting electron beams, a first controlling electrode for controlling an amount of the electron beam emission, and an accelerating electrode for accelerating the electron beams, the electron gun including a power supplying part for examining a received video signal, determining a mode of the video signal, selecting a power of an appropriate level from a plurality of power levels according to a result of the determination, and supplying the selected power to the first controlling electrode and a second controlling electrode disposed between the cathodes and the first controlling electrode for controlling an emission radius of the electron beam according to the power of an appropriate level supplied to the first controlling electrode, thereby satisfying a high luminance as well as a high resolution requirements, whereby allowing processing of various modes of images with one electron gun and effective application of the electron gun to a multimedia.

17 Claims, 7 Drawing Sheets

ELECTRON GUN FOR COLOR CATHODE RAY TUBE

BACKGROUND OF THE INVENTION

1. Field of the Invention

The present invention relates to an electron gun for a color cathode ray tube.

2. Discussion of the Related Art

The electron gun for a color cathode ray tube is means for displaying desired information by emitting three electron beams and focusing them on a screen, to cause respective electron beams to luminesce R, G, B fluorescent materials to form a pixel. Main functions of the electron gun are formation of an object point by the electron beams and focusing of the electron beams, which are main factors that determine a luminance and resolution of the color cathode ray tube. The most important factor that determines the luminance of the color cathode ray tube is a beam current, and the most important factor that determines the resolution is a size of a beam spot. Because the size of a beam spot becomes the larger as the beam current becomes the greater, realization of a high luminance and a high resolution on the same time has been impracticable, and requirements for high degrees of control technologies for the electron gun, deflection means, screen and circuit result to high cost of parts. In the meantime, CPT (color picture tube) mostly for use in displaying moving pictures, such as television and video watching and CDT (color data tube) mostly for use in CAD and displaying character information are manufactured differently. In most cases, the CPT is provided to display a moving picture and should have a high luminance aid contrast, and the CDT is provided to display character and graphic information and should have a high resolution.

The structure and operation of a background art electron gun for a color cathode ray tube will be explained with reference to FIGS. 1 to 7. FIG. 1 illustrates a horizontal section of the background art electron gun for a color cathode ray tube, and FIG. 2 illustrates a vertical section of the background art electron gun for a color cathode ray tube.

Referring to FIG. 1 and 2, the background art electron gun is provided with R, G, B cathodes 1, 2 and 3, a first electrode 4, a second electrode 5, a focus electrode 6, anode 7 and a shield cup 8, with three apertures in a horizontal direction for pass-through of the electron beams in each of the electrodes. The R, G, B cathodes 1, 2 and 3 are provided for emitting electron beams, the first electrode 4 is provided for controlling amounts of the electron beam emissions, the second electrode 5 is provided for accelerating the electron beams, and the focusing electrode 6 and the anode 7 converge the electron beams. Each of the electrodes are applied of an appropriate level of voltage for conducting a required operation. That is, each of the R, G, B cathodes 1, 2 and 3 is applied of a few to a few tens of a voltage, the first electrode 4 is applied of zero voltage, the second electrode 5 is applied of a few hundreds of a voltage, the focusing electrode 6 is applied of a few thousands of a voltage, and the anode 7 is applied of a few tens of a thousand voltage. Thus, upon application of different voltages to respective electrodes, paths of the electron beams are formed as shown in FIG. 4 along which the electron beams proceed. That is, an electric field by the second electrode 5, being an accelerating electrode, influences up to the cathode 2 so that electrons emitted from the cathode 2 is extracted from the cathode 2. In this instance, the first electrode 4, applied of a voltage at a level lower than the cathode 2 and the second electrode 5, suppresses the electron beam extraction to control an amount of the electron beam extraction by means of a voltage difference between them. In general, the voltage to the first electrode 4 is fixed while the voltage to the cathode 2 is varied, for controlling the amount of the electron beam emission.

In the meantime, an electron beam from a surface of the cathode is crossed through its beam axis by voltage distributions of the cathode, the first electrode and the second electrode. That is, as shown in FIG. 3, an electron beam crossing 100 is occurred by the electric field. After occurrence of the crossing 100, the electron beam 101 is made to advance toward the screen by electric fields becoming higher from the second electrode 5 to the focusing electrode 6, during which process, the electron beam 101 is subjected to primary convergence by a weak electric field formed between the second electrode 5 and the focusing electrode 6, and subjected to secondary convergence by a strong electric field formed between the focusing electrode 6 and the anode 8, so as to be focused on a point of the screen.

FIG. 4 illustrates an equivalent optical model of a beam path formed by the electric fields in the electron gun. A lens formed by the electric field between the second electrode 5 and the focusing electrode is called a pre-focusing lens 10, and a lens formed by the electric field between the focusing electrode 6 and the anode 7 is called a main lens 12. Being a beam 102 subjected to primary convergence by the pre-focusing lens 10, the beam incident to the main lens 12 is different from the beam 101 crossed before the pre-focusing. The beam 102 before incident to the main lens 12 is drawn only to show outermost beam contours, but the beam 102 has numerous fluxes of electron beams as shown in FIG. 3, actually. Reverse direction extension lines of the beam 102 travel paths form a virtual crossing 110 on a cathode 2 side. This virtual crossing point is an object point 111 of the main lens 12, a size of the electron beam at the point is an object radius Rx, and a distance from the object point 111 to the main lens 12 is an object distance p. On the other hand, the electron beam passed through the main lens 12 is focused onto the screen, which focused point is called an image point 112, and a distance from the main lens 12 to the image point is an image distance q, and a size of the electron beam at the image point is a spot size Dt. Eventually, an object point 111 with a radius Rx and a distance p is formed into an image point 112 with a spot size Dt on the screen. In the meantime, inclusive of the prefocusing lens 10 which forms the current beam and the object point incident to the main lens 12, there is a triode with the cathodes, the first electrode, the second electrode, and up to the apertures in the focusing electrode on the cathode side. The size Dt of the electron beam spot which is a main factor for determining a resolution of a color cathode ray tube may be expressed as an equation 1 shown below.

$$Dt=M\times Dx,$$

where, M is a magnifying power of the main lens determined by a shape of the lens and a voltage applied thereto, and Dx, being 2Rx, is an object diameter. As can be known from the equation 1, the object diameter is a main factor that determines the resolution. In the electron gun, the object diameter becomes the greater as a current is the greater, that is dependent on diameters of the apertures of the first and second electrodes.

FIG. 5 illustrates a vertical section of a triode in an electron gun for a CPT which has a high luminance and a low resolution, and FIG. 6 illustrates a vertical section of a triode in an electron gun for a CDT which has a low luminance and a high resolution.

Referring to FIGS. 5 and 6, the structure and operation of the two electron guns are the same with the explanations given, they have differences in their aperture diameters of the first and second electrodes. That is, a Rp, the aperture diameter either of the first and second electrodes 4 and 5 of the CPT electron gun shown in FIG. 5 is greater than a Rd, the aperture diameter either of the first and second electrodes 4-1 and 5-1 of the CDT electron gun shown in FIG. 6, for using a large current range without any excessive increase of a cathode load required for providing a high luminance in the case of the CPT, which however means that a high resolution can not be obtained due to increased object diameter. On the contrary, in the case of a CDT which requires a high resolution, i.e., a small object diameter, the aperture diameters Rd of the first and second electrodes should be small, resulting in a reduced beam current. It can be explained in more detail as follows. The load on a cathode is an amount of beam current per a unit beam emission area of the cathode, i.e., a beam current concentration. Therefore, it is required to increase the emission area for increasing the beam current. And, a maximum beam emission area is a maximum area on the cathode to which the voltage of the second electrode can influence, with a maximum emission radius of Rp in the case of FIG. 5 and Rd in the case of FIG. 6. FIG. 7 illustrates a graph showing current range vs. spot size in background art electron guns for CPT and CDT. With reference to FIG. 7, it can be known that the CPT has a greater spot size and uses up to a high current range and the CDT has a smaller spot size and uses a low current range.

The background art electron gun for a color cathode ray tube has the following problems.

An electron gun for the CPT can not conduct a CDT mode, and vice versa. Accordingly, the background art electron guns are not adaptive to a multimedia environment of which importance increases gradually in which they should be used interchangeably, putting a limitation on a multipurpose use of the electron guns.

SUMMARY OF THE INVENTION

Accordingly, the present invention is directed to an electron gun for a color cathode ray tube that substantially obviates one or more of the problems due to limitations and disadvantages of the related art.

An object of the present invention is to provide a multipurpose electron gun for a color cathode ray tube which can conducts a CPT mode as well as a CDT mode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun for a color cathode ray tube having a plurality of cathodes for emitting electron beams, a first controlling electrode for controlling an amount of the electron beam emission, and an accelerating electrode for accelerating the electron beams, includes a power supplying part for examining a received video signal, determining a mode of the video signal, selecting a power of an appropriate level from a plurality of power levels according to a result of the determination, and supplying the selected power to the first controlling electrode and a second controlling electrode disposed between the cathodes and the first controlling electrode for controlling an emission radius of the electron beam according to the power of an appropriate level supplied to the first controlling electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 8:
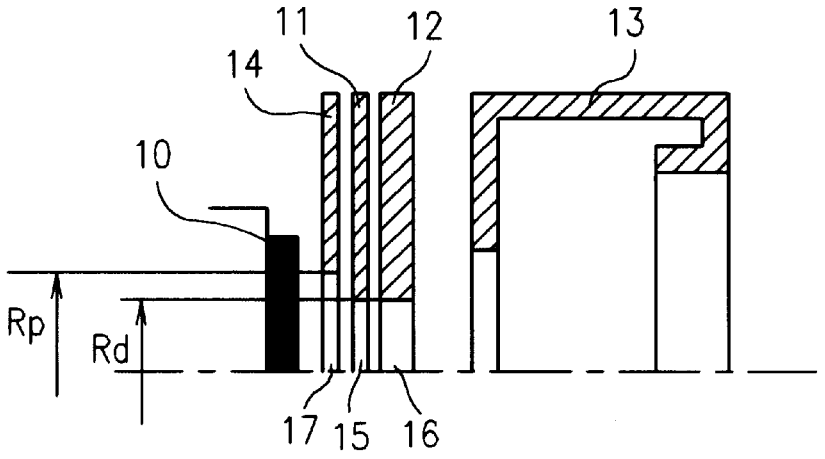
FIG. 8 illustrates a longitudinal section of an electron gun for a color cathode ray tube in accordance with a preferred embodiment of the present invention.

Reference will now be made in detail to the preferred embodiments of the present invention, examples of which are illustrated in the accompanying drawings. FIG. 8 illustrates an electron gun for a color cathode ray tube in accordance with a preferred embodiment of the present invention.

Referring to FIG. 8, the electron gun for a color cathode ray tube in accordance with a preferred embodiment of the present invention includes a cathode 10, a first electrode 11, a second electrode 12 and a focusing electrode 13, with an addition of a beam emission radius controlling electrode 14 between the first electrode 11 and the cathode 10, wherein aperture radiuses Rd 15 and 16 in the first and second electrodes 11 and 12 are set to a level for processing a character broadcasting signal and an aperture radius Rp 17 in the beam emission radius controlling electrode 14 is set so as to have a relation of Rp>Rd.

Figure 9:
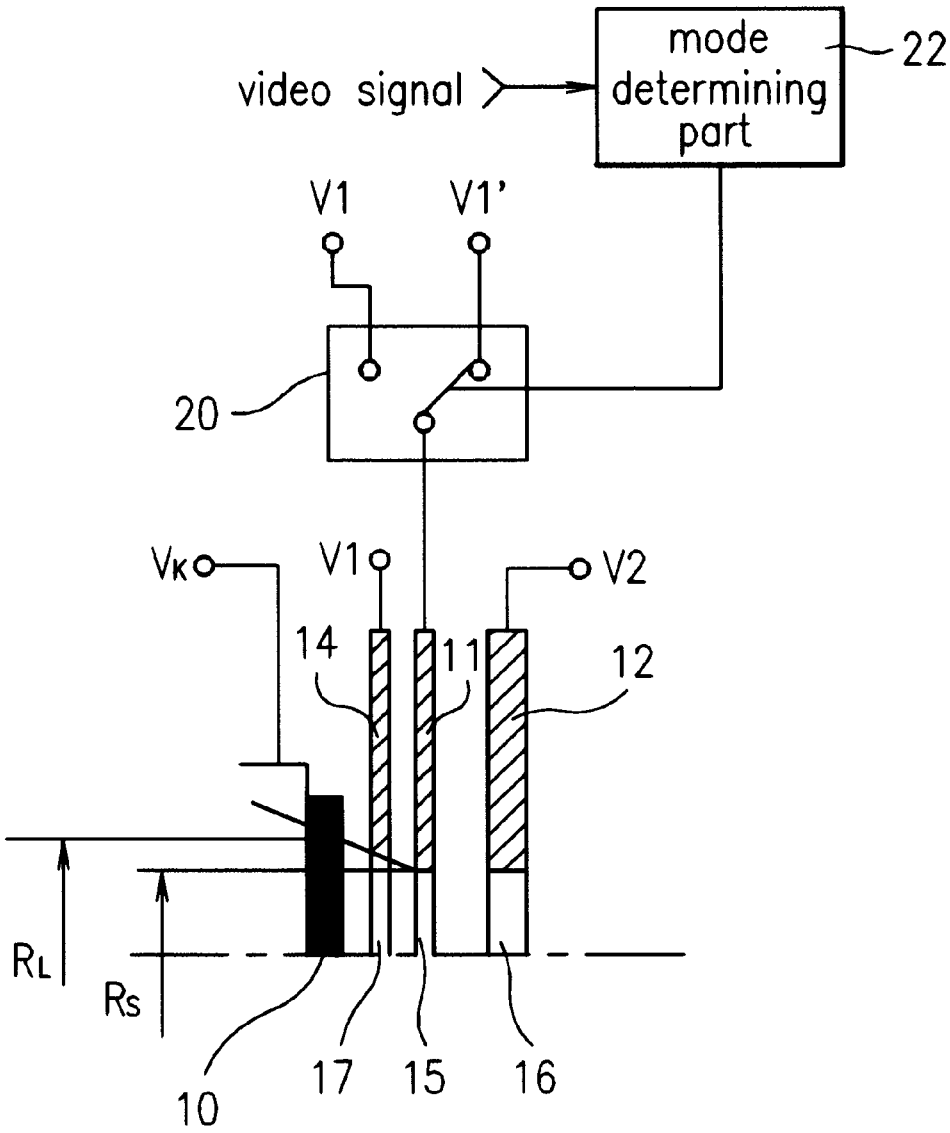
FIG. 9 explains the operation of an electron gun for a color cathode ray tube in accordance with a preferred embodiment of the present invention.

Referring to FIG. 9, the cathode 10 is applied of a few to a few tens of a cathode voltage Vk, and the second electrode 12 is applied of a few hundreds of a voltage as a second electrode voltage V2. A voltage to be applied to the first electrode 11 should be set to be the same with or higher than a voltage V1 to be applied to the beam emission radius controlling electrode 14, and a voltage to be applied to the first electrode 11 should be set to be below the voltage to be applied to the second electrode 12. And, the first electrode 11 is provided with a switch 20 for switching between voltages V1 and V1' different from each other according to a moving picture processing mode and a character broadcasting signal processing mode. The switch 20 has a control side for receiving a mode determining signal from a mode determining part 22 which is adapted to determine a mode on reception of a video signal. When the voltage to the beam emission radius controlling electrode 14 and the voltage to the first electrode 11 are identical, the maximum electron beam emission radius is caused to be Rs, and when the voltage to the first electrode 11 is greater than the voltage to the beam emission radius controlling electrode 14, the maximum electron beam emission radius is caused to be expanded to $R_L$. That is, a size of the electron beam emission radius is varied depending on a strength of the voltage to the first electrode 11. Thus, by varying the electron beam emission radius with the voltage of the first electrode in the present invention, a large current can be obtained without any increased cathode 10 load.

Figure 10:
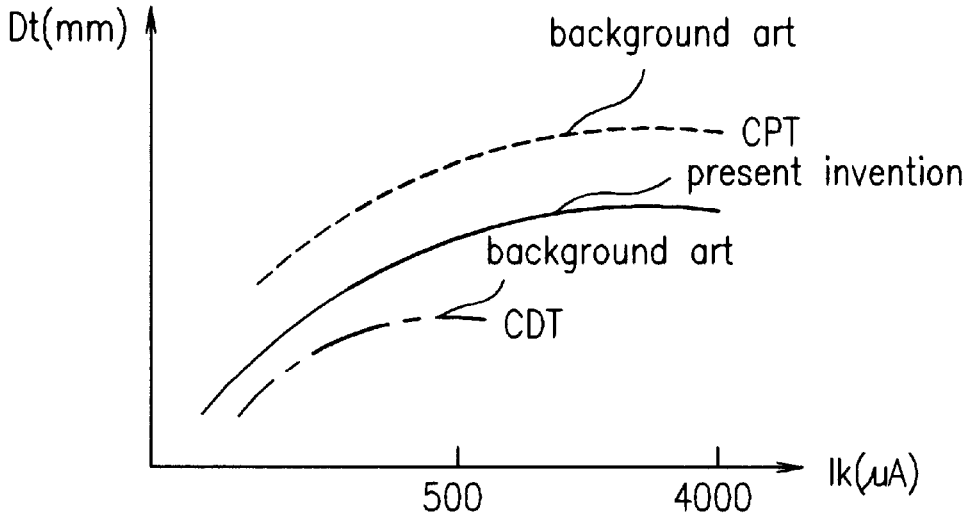
FIG. 10 illustrates a graph showing beam current vs. spot size in an electron gun in accordance with a preferred embodiment of the present invention.

In the meantime, since the aperture radius Rd 15 and 16 of the first and second electrodes 11 and 12, which determines the object point size, is formed small so as to process a character broadcasting signal, the object point is formed small, with consequent small beam spot size. Fig. 10 illustrates a graph showing beam current vs. spot size in an electron gun in accordance with a preferred embodiment of the present invention.

Referring to FIG. 10, the electron gun of the present invention has a spot size almost identical to the case of the background art electron gun for processing a character broadcasting signal in a low current range, but has a spot size significantly smaller than the case of the background art electron gun for processing a moving picture signal in a high current range. Therefore, by providing the first and second electrodes each with a smaller aperture radius and a beam emission radius controlling electrode with an aperture radius greater than that of the first and second electrodes disposed between the cathode and the first electrode, the electron gun of the present invention can be used from a low to high current range without any increased cathode load while keeping the object point small, thus embodying an electron gun for a color cathode ray tube, which can satisfy the high luminance as well as a high resolution requirements.

Figure 1:
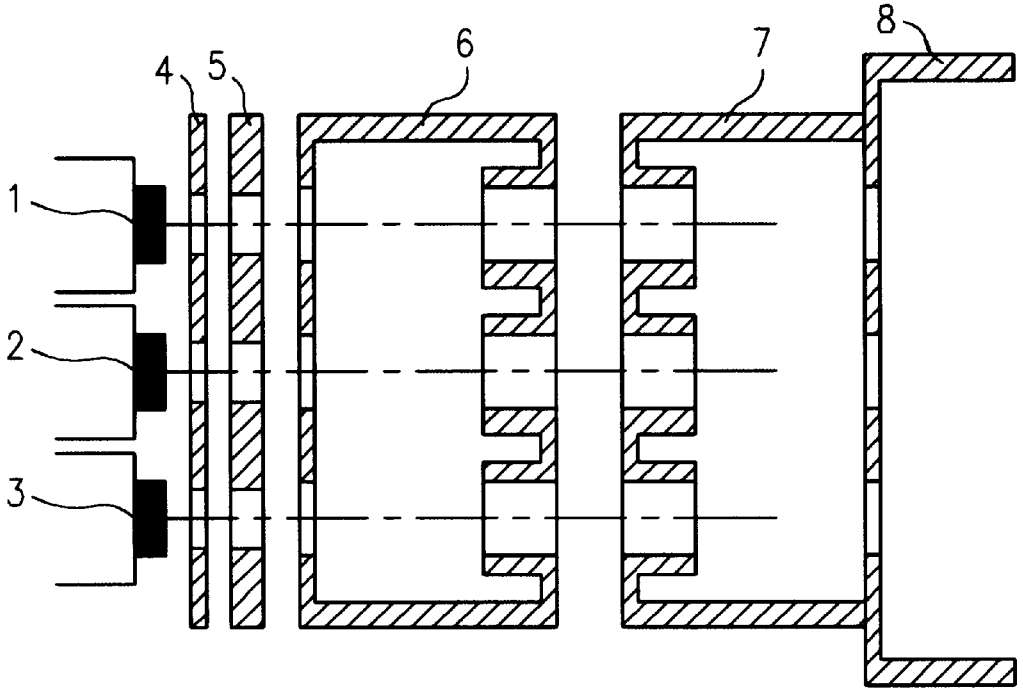
FIG.1 background art
FIG. 1 illustrates a horizontal section of a background art electron gun for a color cathode ray tube.
Figure 2:
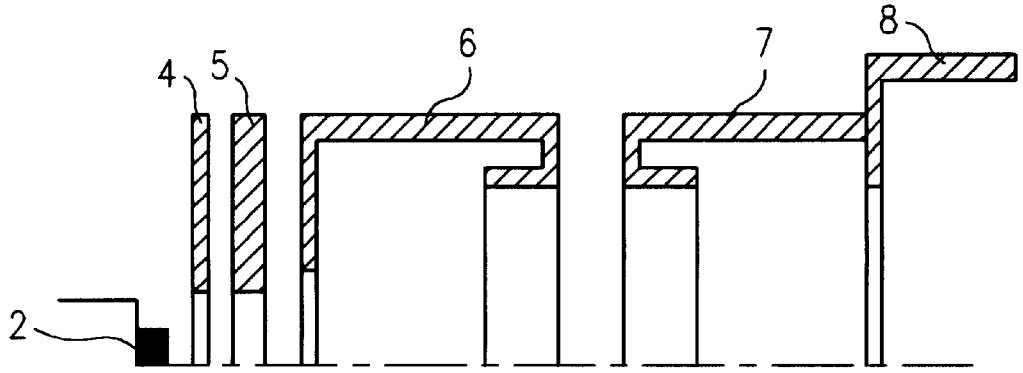
FIG.2 background art
FIG. 2 illustrates a vertical section of the background art electron gun for a color cathode ray tube.
Figure 3:
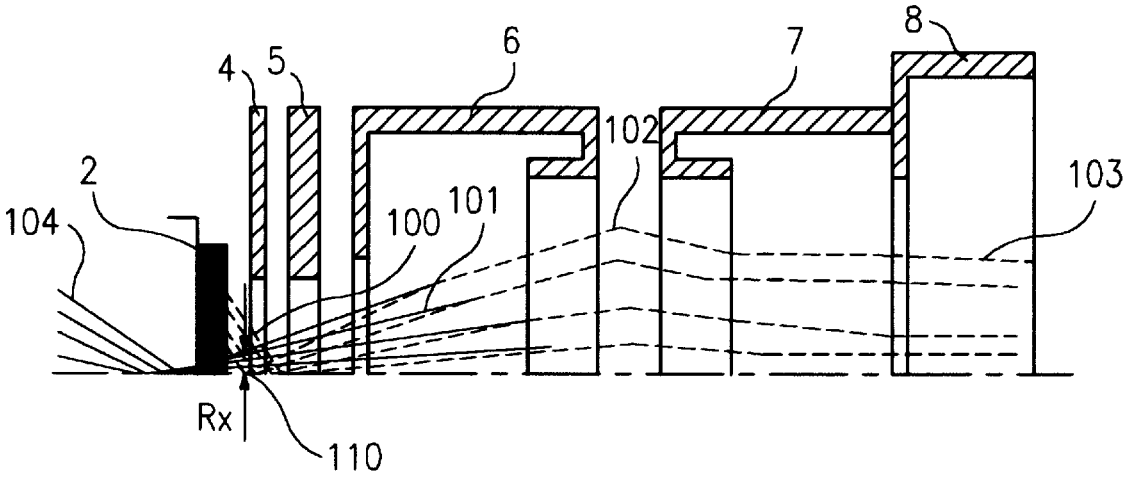
FIG.3 background art
FIG. 3 illustrates a flow of an electron beam in a background art electron gun for a color cathode ray tube.
Figure 4:
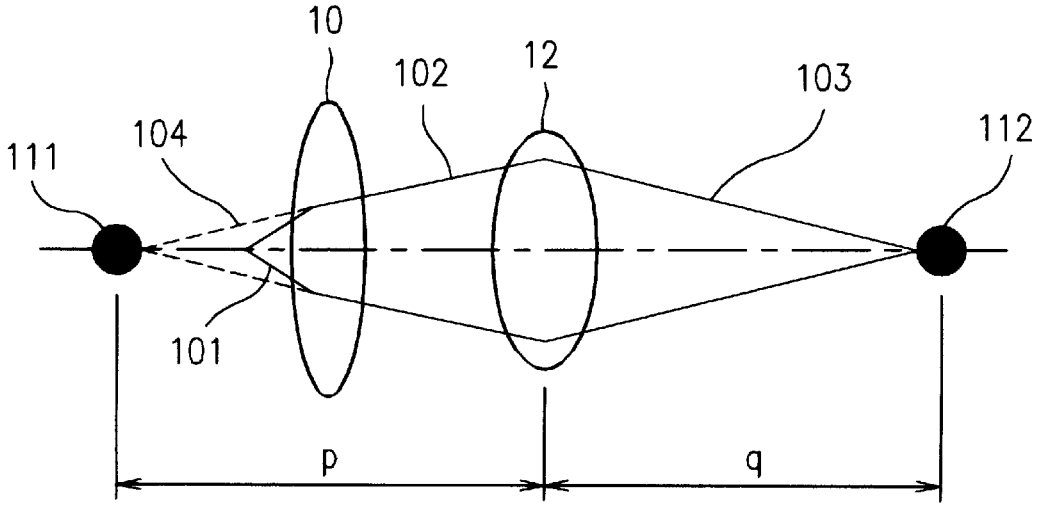
FIG.4 background art
FIG. 4 illustrates an equivalent optical model of the electron beam shown in FIG. 3.
Figure 5:
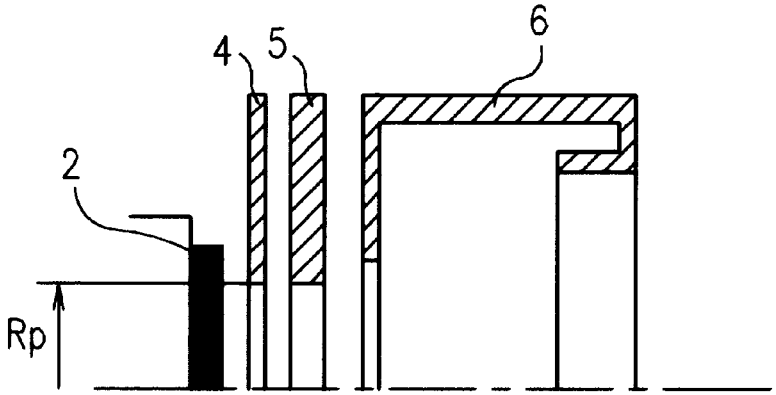
FIG.5 background art
FIG. 5 illustrates a vertical section of a background art electron gun for a CPT.
Figure 6:
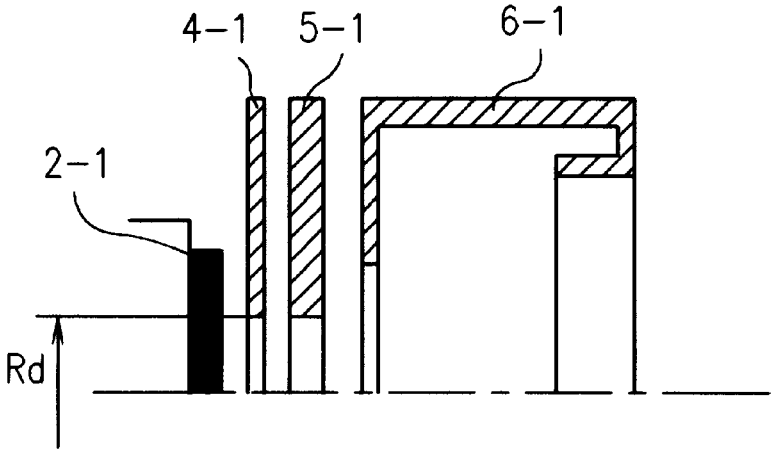
FIG.6 background art
FIG. 6 illustrates a vertical section of a background art electron gun for a CDT.
Figure 7:
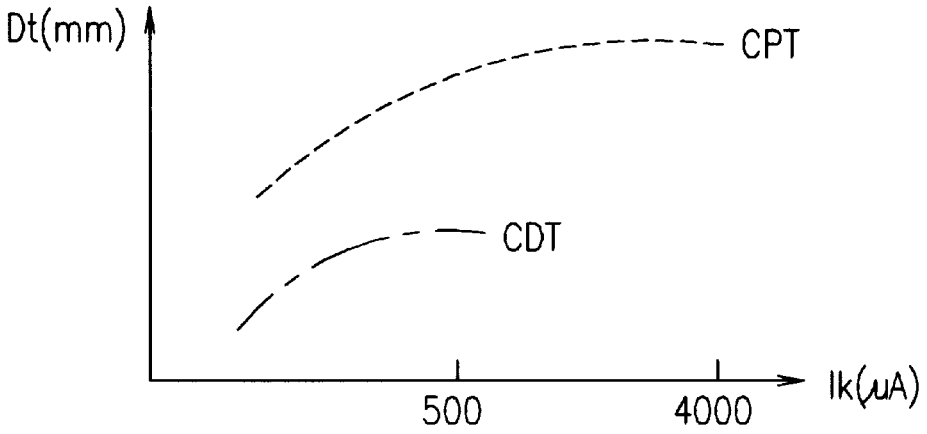
FIG.7 background art
FIG. 7 illustrates a graph showing beam current vs. spot size in background art electron guns.
Figure 11:
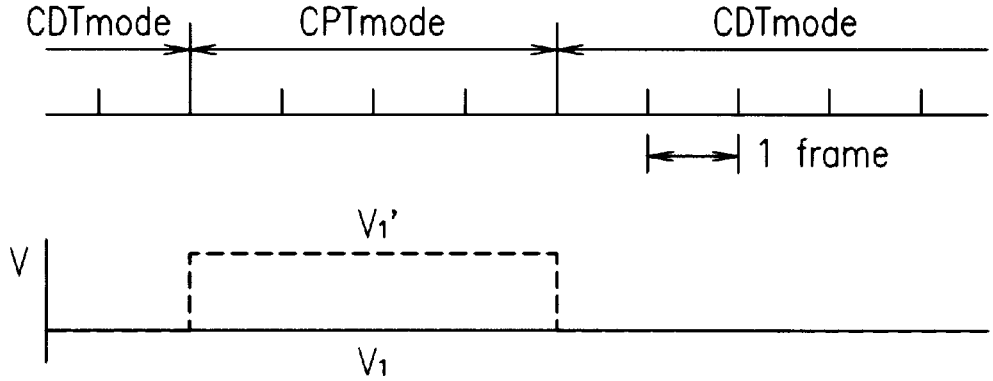
FIG. 11 illustrates a method of voltage application and the waveform in an electron gun for a color cathode ray tube in accordance with a preferred embodiment of the present invention.
Figure 12:
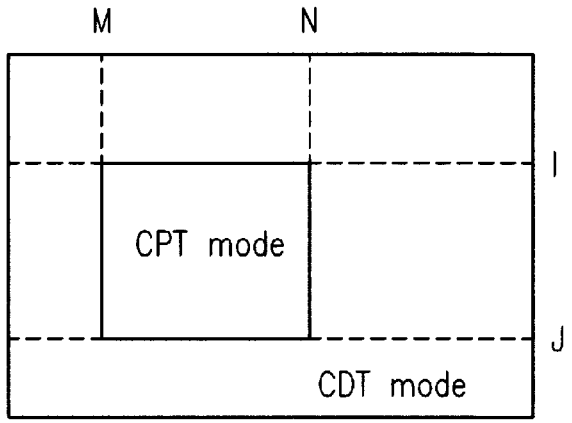
FIG. 12 illustrates a multiple mode of an image on a screen.
Figure 13:
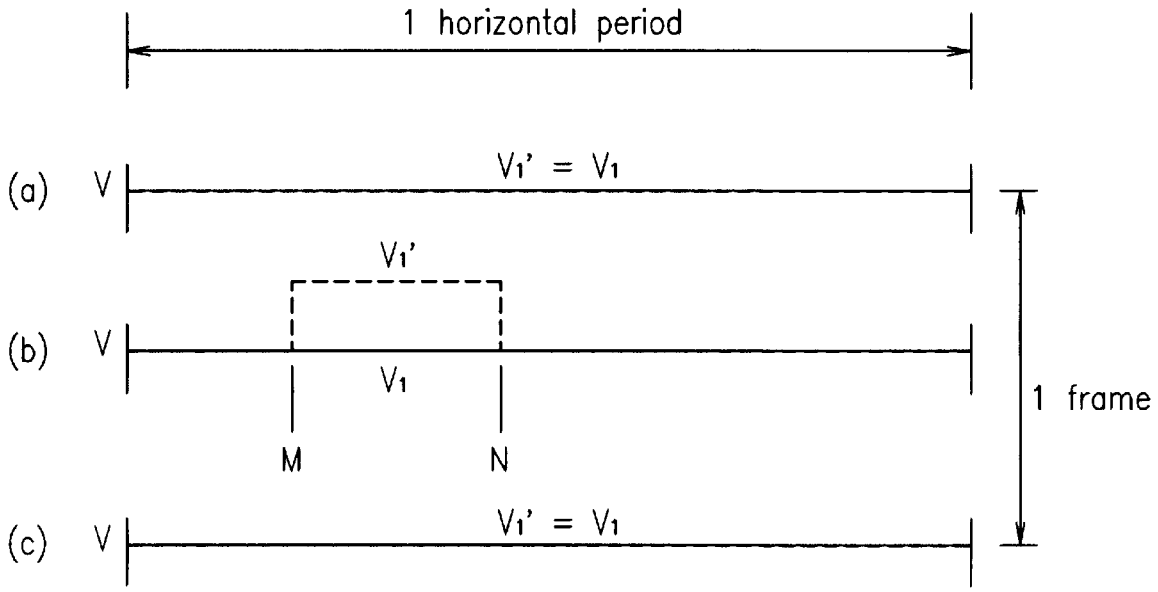
FIGS. 13*a*–13*c* illustrate waveforms of voltage applications 9 obtained by scanning the screen by each horizontal periodic signal.

In case of switching the electron gun of the present invention to have modes of a moving picture signal and a character broadcasting signal, application of modes different from each other for entire screen is possible as shown in FIG. 11. And, application is also possible even to the case when images of two modes are displayed the same screen as shown in FIG. 12. This is made possible by varying the voltage level applied to the first electrode as shown in FIGS. 11, 13*a*–13*c*. That is, when it is intended that images of two modes different from each other are displayed on the same screen as shown in FIG. 2, the images can be displayed as shown in FIG. 12 by applying a voltage for the mode relevant to respective regions for every scanned horizontal periodic signal in an interlaced scanning, as shown in FIG. 13*b*.

Accordingly, the present invention can satisfy the requirement of varied mode for processing moving picture information as well as character information under a multimedia environment with one electron gun, allowing to overcome the limitation placed on the electron gun in processing images of different modes.

It will be apparent to those skilled in the art that various modifications and variations can be made in the electron gun for a color cathode ray tube of the present invention without departing from the spirit or scope of the invention. Thus, it is intended that the present invention cover the modifications and variations of this invention provided they come within the scope of the appended claims and their equivalents.

What is claimed is:

1. An electron gun comprising: a plurality of cathodes for emitting electron beams;

a first controlling electrode having a first aperture that controls an emission radius of the electron beams;

an accelerating electrode having a second aperture with a substantially same diameter to a diameter of the first aperture, that accelerates the electron beams;

a second controlling electrode disposed between the cathodes and the first controlling electrode, having a third aperture with a diameter greater than the diameter of the first aperture, that controls the emission radius of the electron beams;

a power supplying part having a plurality of powers, each power having a different level; and a selecting part that selects one of the plurality of powers in response to a mode determined in response to an input video signal, applies the selected power to the first controlling electrode and controls the emission radius of the electron beams in accordance with the difference between a power level of the first controlling electrode and a power level of the second controlling electrode.

2. The electron gun of claim 1, wherein the power supplying part receives the input video signal as one of a moving picture processing mode and a character broadcasting signal processing mode, and controls a power level of the first controlling electrode such that at least one mode is displayed on an entire screen.

3. The electron gun of claim 1, wherein a radius of the first aperture and a radius of the second aperture are set to a character broadcasting signal processing mode.

4. The electron gun of claim 1, wherein the power applied to the first controlling electrode is substantially equal to or greater than a power applied to the second controlling electrode.

5. The electron gun of claim 4, wherein a switching part applies a substantially identical power level to the first controlling electrode and the second controlling electrode to select the first aperture to control the emission radius, and a greater power level to the first controlling electrode than the second controlling electrode to select the third aperture to control the emission radius.

6. The electron gun of claim 1, wherein the power applied to the first controlling electrode is less than a power applied to the accelerating electrode.

7. The electron gun of claim 1, wherein the selecting part receives one field of a video signal from the input video signal to determine a mode for an entire screen.

8. The electron gun of claim 1, wherein the selecting part receives one frame of a video signal to determine a mode for an entire screen.

9. The electron gun of claim 1, wherein the selecting part determines modes different from each other contained in every horizontal periodic signal.

10. The electron gun of claim 1, wherein the first, second and third apertures are commonly aligned along a single axis.

11. An electron gun that emits at least one electron beam, comprising:

a first controlling electrode;

a second controlling electrode disposed between a plurality of cathodes and the first controlling electrode; and a mode selecting circuit that receives a control signal that is based on an input video signal determines a mode in response to the control signal, selects one of a plurality of powers that corresponds to the determined mode, and applies the selected power to the first controlling electrode, wherein the selected power determines an emission radius of the at least one electron beam.

12. The electron gun of claim 11, wherein the first controlling electrode comprises a first aperture and the second controlling electrode comprises a second aperture, and the first aperture and the second aperture are commonly aligned along a single axis.

13. The electron gun of claim 11, wherein the mode selecting circuit receives from the input video signal one of a field of a video signal and a frame of a video signal, to determine the mode.

14. The electron gun of claim 11, wherein the mode selecting circuit receives the control signal as one of a high resolution mode and a high luminescence mode, and at least one mode is displayed on a display device.

15. The electron gun of claim 14, wherein the high resolution mode is a character broadcasting signal processing mode, the high luminescence mode is a moving picture processing mode, and the diameter of a first aperture of the first electrode is set to the character broadcasting signal processing mode.

16. The electron gun of claim 11, wherein the first controlling electrode determines the emission radius when a substantially identical power level is applied to the first controlling electrode and the second controlling electrode, and the second controlling electrode determines the emission radius when a greater power level is applied to the first controlling electrode than the second controlling electrode.

17. The electron gun of claim 11, wherein the mode selected by the mode selecting circuit differs from an adjacent mode of a horizontal periodic signal.

* * * * *